United States Patent [19]

Blessing

[11] 4,061,327

[45] Dec. 6, 1977

[54] FOLDING APPARATUS

[76] Inventor: Hubert Blessing, 4431 Bobbitt Drive, Dallas, Tex. 75229

[21] Appl. No.: 671,625

[22] Filed: Mar. 29, 1976

[51] Int. Cl.[2] ..... B65H 45/00

[52] U.S. Cl. ..... 270/78; 270/67; 270/80; 270/83; 74/520

[58] Field of Search ..... 270/78, 67, 80–85; 74/520–522, 38, 53, 88, 106, 110

[56] References Cited

U.S. PATENT DOCUMENTS

| | | | |
|---|---|---|---|
| 1,024,459 | 4/1912 | Seymour | 270/78 |
| 1,124,375 | 1/1915 | Wood | 270/78 |
| 1,672,935 | 6/1928 | Goodwin | 270/78 |
| 3,452,623 | 7/1969 | Bastian | 74/520 |
| 3,892,138 | 7/1975 | Vomberg | 74/520 |

*Primary Examiner*—E. H. Eickholt
*Assistant Examiner*—A. Heinz
*Attorney, Agent, or Firm*—Limbach, Limbach & Sutton

[57] ABSTRACT

A work piece is positioned with respect to a folding blade on a positioning table and electromechanical means, acting through a toggle linkage, raise a folding blade through a slot in the table to fold the work piece and simultaneously jam it into a pair of closed jaws mounted on a transfer device which crease the work piece and carry it to a second position where the creased work piece is released to fall upon a conveyor belt.

7 Claims, 3 Drawing Figures

FOLDING APPARATUS

BACKGROUND OF THE INVENTION

The present invention relates to means for actuating a folding blade and more particularly to apparatus for use in the garment industry for creasing a fabric work piece.

In automated garment fabrication devices it is sometimes desirable to fold and crease and fabric work piece so that it then may be sewn along the folded together edges. One example of such operation is in the automated manufacture of front pockets for use in jeans. During such a procedure a facing ply is dropped onto a pocket liner, the two pieces are sewn together along one edge of the facing ply and the sewn together pieces are then folded over and the folded together edges are sewn to form the complete pocket. The pocket is later installed in the front panels of the jeans.

The folding and creasing operation is extremely difficult to carry out mechanically because the fabric work pieces are limp and have no resiliency. They therefore are difficult to grip and to position. In one prior art folding device a fabric work piece is dropped between overlying and underlying moving conveyor belts which, between them, fold over the work piece and transport it to a second location. See U.S. Pat. No. 3,669,443. In another device a movable die actually lifts the edge of the work piece, folds it over and then presses the fold to crease it. See U.S. Pat. No. 3,493,151.

Such prior art devices suffer from such various disadvantages as being incapable of exerting enough force to firmly crease the work piece or being incapable of exactly aligning the fold line on the work piece.

To crease firmly the work piece requires the application of a good deal of force, in a short period of time, and at a precisely controlled moment. These criteria have been difficult to meet with heretofore known electromechanical or pneumatic type actuators without bulky, expensive mechanisms.

SUMMARY OF THE INVENTION

The above and other disadvantages of prior art garment work piece folding and creasing devices are overcome by the present invention of an improved apparatus for impacting a work piece, such as a fabric work piece, with a rigid shaping element, such as a folding blade. The apparatus of the present invention comprises means for selectively actuating the shaping element to travel in a predetermined direction from a first position to a second position and back again, and means for positioning the work piece at the second position to be impacted by the shaping element. In the preferred embodiment the impacting of the shaping element with the work piece causes it to be folded.

In order to provide the large force necessary to effect the fold in a precisely controlled, short period of time, the shaping element actuating means comprise a selectively lockable toggle linkage which is connected at one end in a driving relationship with the shaping element. Means are further provided for applying a constantly reciprocating, linear driving force to the other end of the toggle linkage. The toggle linkage, when locked, is capable of transmitting the linear driving force applied to its other end in the direction of its length. Electromechanical actuator means selectively lock the toggle linkage in order to transmit instantaneously the driving force to the shaping element.

To effect the crease, the apparatus of the invention further comprises resilient clamping means having a pair of gripping jaws positioned with respect to the shaping element of folding blade and the work piece such that the folded work piece is jammed in between the jaws at the fold by the actuated folding blade and is thereafter pulled free of the folding blade by the jaws upon withdrawal of the folding blade. The clamping means are selectively openable and closeable and are mounted on a transport mechanism for moving the work piece and clamping means from the location of the folding blade to a second location where the clamping jaws are caused to automatically release the work piece onto a conveyor belt.

The reciprocating driving means comprise a lever arm oscillated up and down by the action of an eccentric cam mounted on the end of a constantly rotating motor shaft. In more detail, the toggle linkage includes a pair of links pivoted to each other at one end with one end of one link driven by the reciprocating driving force and the other end of the other link being operatively connected to the folding blade. The pivot point which joins the two links together diverts outwardly the dissipate the driving force unless it is locked. It is locked by means of an electromechanical actuator which holds the pivot point stiff so that the two linds translate together roughly in the direction of their longitudinal axes.

The means for positioning the work piece so that it may be folded by the folding blade comprise a transparent table for supporting the work piece with the table having a slot through its center to accommodate the movement of the folding blade. Motor means are provided for moving the table in at least two directions which are orthogonal to the direction of the movement of the folding blade and for rotating the work piece in a horizontal plane in response to electrical position control signals. These control signals are generated by photo optic sensors mounted beneath the table surface which shine a light upwardly through the table and detect the reflected light to produce the control signals.

One benefit in having a toggle linkage actuating means for the folding blade is that the folding blade is a relatively heavy mechanism which must be actuated in an extremely short period of time with considerable force because of the short timing relation between the balde and the jaw movement cycle. To exert this type of force in the relatively narrow time required either by pneumatic or electromechanical means would be nearly impossible because of the high inertial forces required. Furthermore, if electromechanical means are used, extremely high electric currents and inductive losses would result. By using the toggle linkage actuator, the motor can be kept constantly running so as to avoid the inductive losses. The rotational inertia of the motor is quickly converted into a reciprocating force simply by using a mechanical cam, a lever, and a relatively low current, low force electrical signal to the electromechanical means to lock the toggle linkage, and so establishing a pivot point, into a rigid link which then transmits the converted rotational energy of the motor into the reciprocating driving force to raise the folding blade.

It is therefore an object of the present invention to provide means for shaping a work piece in an extremely small period of time with the minimum amount of power necessary;

It is still another object of the invention to provide a garment work piece folding apparatus which automatically aligns the work piece with respect to the fold line, and It is a still further object of the invention to provide a selective, switchable means to control two co-acting parts with a perfect timed relation to each other.

The foregoing and other objectives, features and advantages of the invention will be more readily understood upon consideration of the following detailed description of certain preferred embodiments of the invention, taken in conjunction with the accompanying drawings.

DETAILED DESCRIPTION OF CERTAIN PREFERRED EMBODIMENTS

Figure 1:
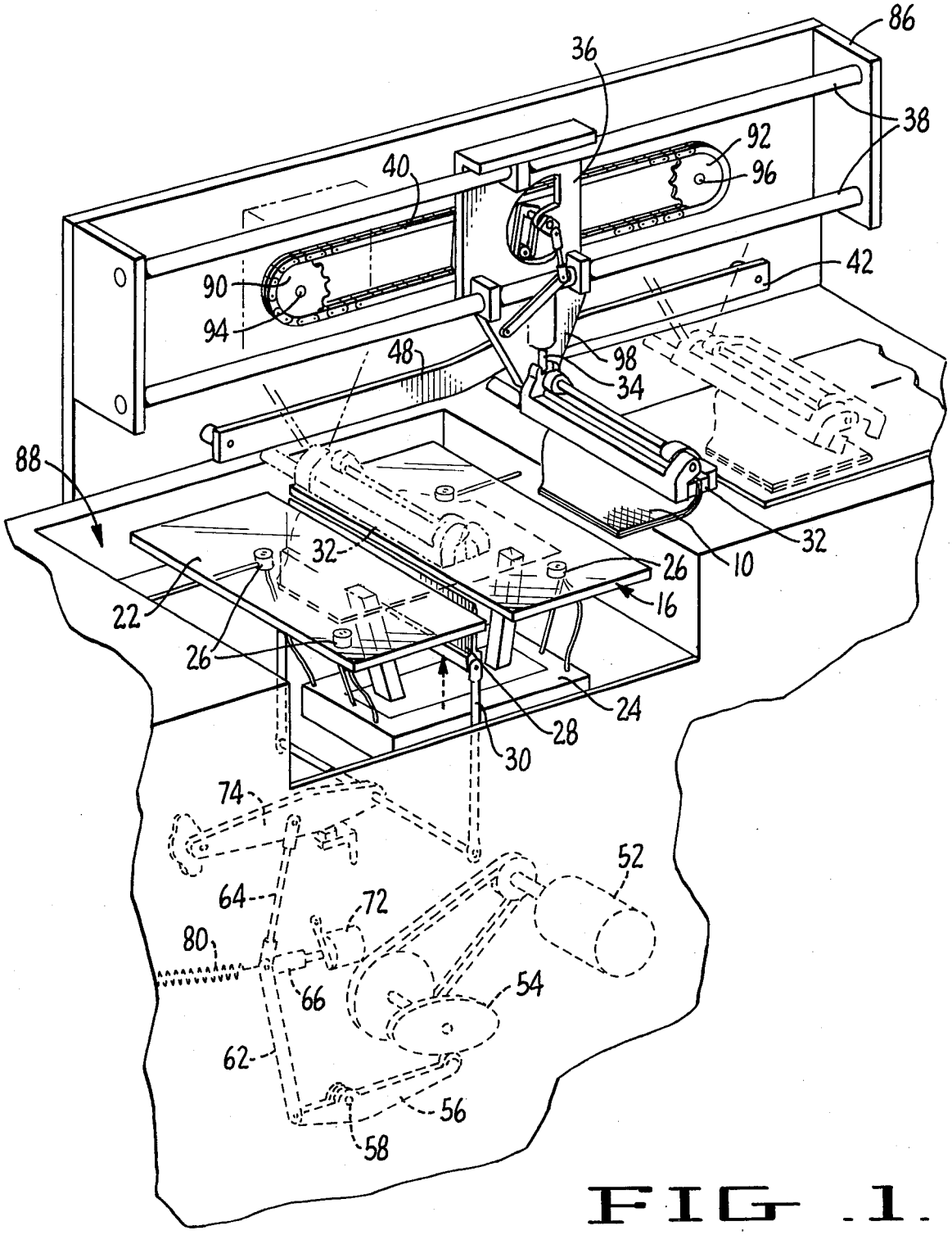
FIG. 1 is a perspective view of the folding apparatus according to the invention with portions broken away and in hidden line.

Referring now particularly to FIG. 1, a fabric, web-like work piece 10 is transported from a previous work station (not shown) by means of a vacuum transfer mechanism (not shonw) to be deposited on a registration table 16. Such a transfer mechanism is fully described in applicant's co-pending patent application entitled INTERMITTENT DRIVE ASSEMBLY AND TRANSFER MECHANISM filed on Feb. 2, 1976 and assigned U.S. Pat. application Ser. No. 654,705.

The registration table 16 includes a transparent support surface 22 which is effectively divided into two pieces in the middle. The plate 22 is generally aligned horizontally. It is supported on top of an electromechanical registration mechanism 24 which is driven by electrical motors (not shown) in a horizontal plane in orthogonal ($x$ and $y$) directions. The motors also rotate the table in the horizontal plane. Photo optic sensors 26 positioned beneath the table shine a light upwardly through the table and detect when this light is reflected by the work piece resting on top of the table. Such photo optic detectors and table registration mechanisms are well known in the art and will therefore not be described in greater detail. See for example U.S. Pat. No. 3,548,196. the photo optic sensors 26 control the table positioning mechanism 24 and are located beneath the table in a prearranged pattern corresponding to the outlines of the work piece when correctly aligned. The sensors are rigidly positioned and do not move with the table surface 22.

After the workpiece 10 has been deposited on the table surface 22 by the transfer mechanism, the transfer mechanism returns to the previous work station to pick up a new work piece. When this happens, the table 24 automatically registers The workpiece in correct alignment with respect to a folding blade 28 normally positioned beneath the table surface 22. Blade 28 is contained in a yoke shaped mounting mechanism 30 which straddles the registration table mechanism 24.

With the work piece 10 properly aligned by the registration table the folding blade 28 is driven upwardly almost instantaneously by a mechanism to be described in greater detail hereinafter. As the blade 28 rises above the surface 22, the work piece 10 is folded over the edge of the blade and is driven between a pair of horizontal clamping jaws 32 which extend parallel to the folding edge of the blade 28 and are suspended over the work piece. The jaws 32 are hinged together and held closed by a pin 34 at one end, as best viewed in FIG. 3. The force of the folding blade 28 in driving the folded fabric 10 into the closed jaws 32 causes the jaws to crease the folded fabric 10.

As the blade 28 is withdrawn from the jaws, the fabric remains clasped in the jaws. The jaws are mounted on a transfer carriage 36 which slides on a pair of rails 38 and is drawn by a rotating driving chain 40, as is described in greater detail in the applicant's above-identified copending patent application. At the end of the travel of the carriage 36, the pin 34 is withdrawn and the jaws 32 open and release the folded and creased work piece 10 on a second conveyor 46 which thereafter carries it along the garment processing assembly line. The pin withdrawal will be explained in greater detail hereinafter. The jaws 32 are closed on the return trip of the transfer carriage 36 to the registration table 16 by means of a linear cam 42 which includes a downwardly extending "step" portion 48 at the registration table 16 which bears against a pair of cam follower rollers 44 mounted on ends of jaws 32 as best viewed in FIG. 2.

Figure 2:
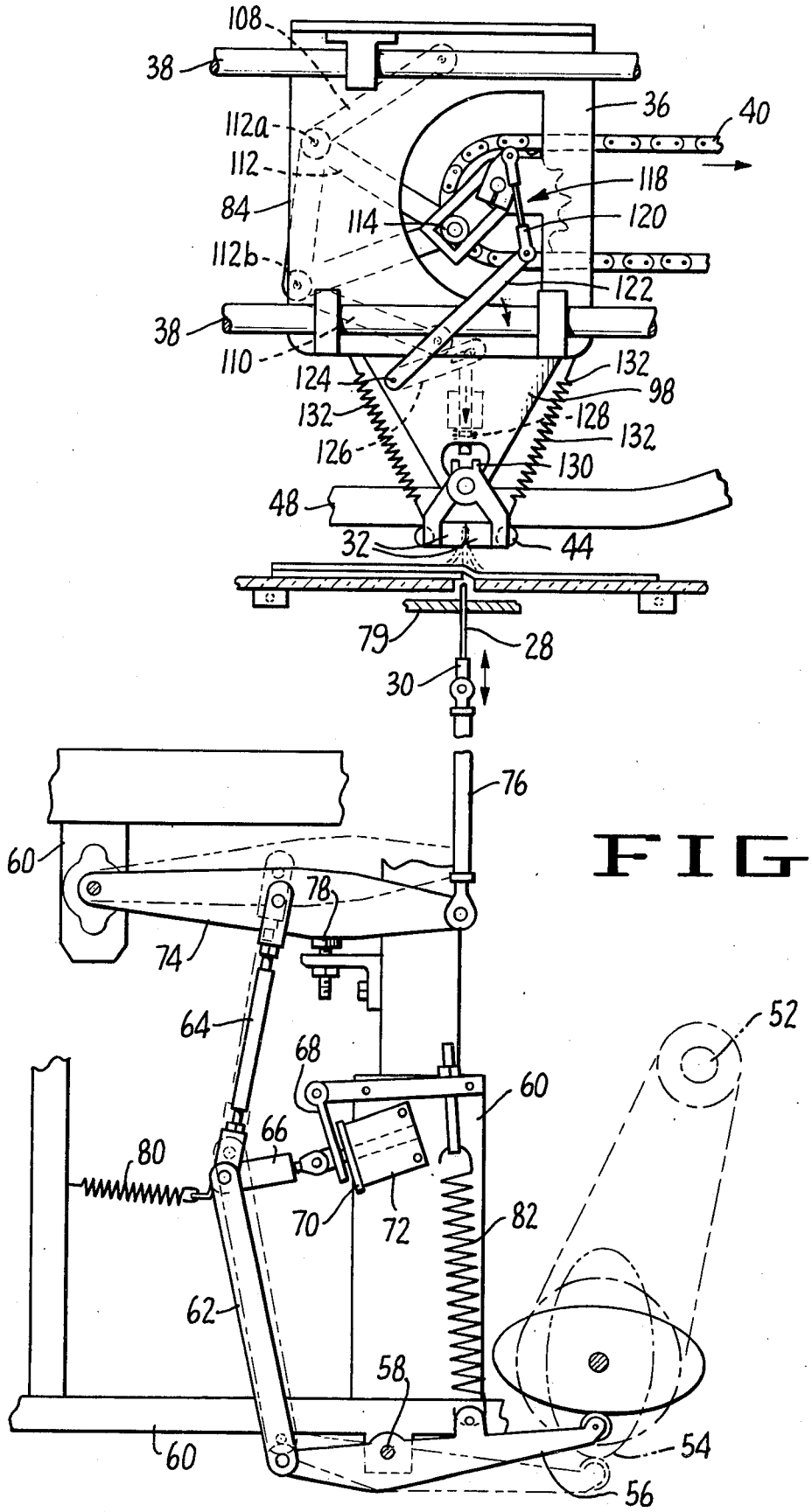
FIG. 2 is an enlarged, rear view, with portions broken away and in section of the embodiment depicted in FIG. 1 prior to the folding of the work piece.
Figure 3:
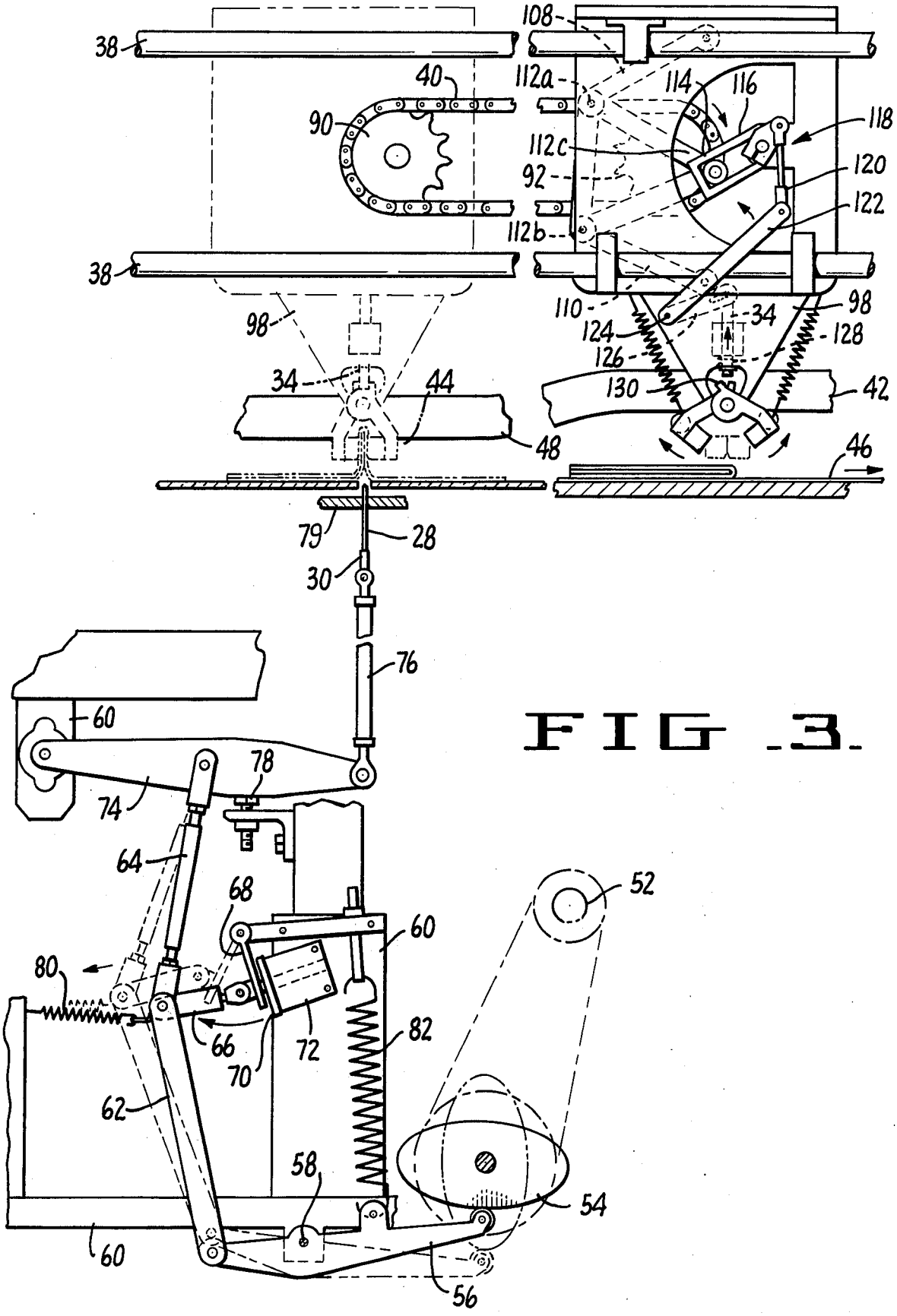
FIG. 3 is a view similar to FIG. 2 but taken after the work piece has been folded.

Referring now more particularly to FIGS. 2 and 3, the knife blade actuator means is illustrated in greater detail. The actuator means includes a motor or machine drive shaft 52 which constantly rotates an eccentric cam 54. The contour of the cam is followed by one end of a lever arm 56 pivoted at a point 58 to the frame 60 in which the actuator mechanism is mounted. The other end of the lever arm 56 is pivotally connected to one end of the first connecting link 62 which is pivotally connected at its other end to a second connecting link 64. This intermediate pivot point or "knee point" is also pivotally connected to a third connecting link 66 which is pivotally supported by the frame 60 by a fourth connecting link 68. The free end of the connecting link 68 has an armature plate 70 affixed to it. A solenoid coil 72 mounted in the frame 60 is placed opposite to the armature plate 70. The other end of the connecting link 64 is pivotally connected to a second lever arm 74 at a point intermediate its ends. One end of the lever 74 is pivoted to the frame 60. The other end of the lever arm 74 is pivotally connected to one end of a connecting rod 76 whose other end is pivotally connected to the yoke 30 which supports the folding blade 28. An adjustable lower stop 78 supports the free end of the lever 74 when the blade is withdrawn to its lower position.

Prior to energization of the solenoid coil 72, the rotation of the cam 54 by the motor 52 causes the lever arm 56 to flex the connecting links 62 and 64 so that they bend much like the human knee. This action is illustrated in dashed line form in FIG. 3. This dissipates the reciprocating driving force produced at the end of the lever 56 where it joins the connecting link 62. No substantial force is transmitted to the folding blade 28. Upon energization of the solenoid coil 72, the armature plate 70 is attracted and clamped to the solenoid coil 72 and causes the pivot between the links 62 and 64 to be constrained and rigid. This prevents the flexing motion and the reciprocating driving force produced by the cam 54 at the end of the lever 56 is transmitted to the unpivoted end of the lever 74 through the links 62 and 64. The transmission of this force lifts the push rod 76 to raise almost instantaneously the folding blade 28 as the eccentric end of the cam 54 pushes against the end of the lever 56. It will thus be appreciated that with a relatively low current signal to the solenoid coil 72 that already running motor 52 can be easily controlled to lift immediately the blade 28 without having to supply a large current signal to the motor or to an electromechanical solenoid. Since the driving mechanism for the folding jaws and the mechanical cam driving the blade may be driven by one means, a fixed relation of time and motion is thereby established. This is extremely important since without this fixed relationship constant misalignment problems would otherwise reoccur, requiring unnecessarily high maintenance costs.

In order to align properly the blade 28 as it enters the slot in the table 22, a pair of guides 79 are disposed on opposite sides of the blade 28 immediately beneath the table 22. The guides, although shown broken away in FIGS. 2 and 3, are rigidly supported on the frame 60. The slot in the table 32 is wide enought to allow sufficient movement of the table relative to the blade 28 to align the workpiece. The toggle links 62 and 64 are connected at their common pivot point by a spring 80 to the frame 60 in order to insure that they flex in the proper direction when the solenoid coil 72 is not energized. Similarly the lever 56 is caused to follow the cam 54 by means of a tension spring 82 attached between the frame 60 and the portion of the lever 56 between the pivot point 58 and the cam 54.

While the above-described toggle linkage has been described particularly with respect to actuating a folding blade, it should be apparent that in other manufacturing operations the same linkage could be utilized to cut fabric, punch holes in fabric or to perform any number of other operations on work pieces of different types. Similarly, the knife blade actuating mechanism could be used in other fabricating operations where instantaneous mechanical response is required with a relatively low power input control signal.

Referring now more particularly to FIGS. 1, 2 and 3, the carriage transfer mechanism of the present invention will be described in greater detail. The carriage transfer mechanism is for the purpose of transporting the pieces of creased fabric from the registration table to a second work station.

The carriage transfer mechanism comprises the carriage 36 which travels along a pair of parallel, vertically spaced apart, upper and lower horizontal rods 38. The rods are fitted in a mounting frame 86 which is rigidly mounted above the working surface 88. The carriage 36 is slid along the rods 38 by means of a driving chain 40 trained around two horizontally spaced apart, motor driven sprocket gears 90 and 92. The sprocket gears 90 and 92 are rotatably mounted on horizontal shafts 94 and 96, respectively. The shafts 94 and 96 are mounted in the frame 86 near the ends of the rods 38. The carriage 36 supports a vertically extending flange 98 on which the horizontally extending jaws 32 are supported.

The particular manner in which the carriage 36 is attached to the driving chain 40 is quite important since it is highly desirable to only produce a tensional force on the chain 40 in the direction of its travel rather than to produce any force which tends to cause the chain to pull away from its direction of travel. Such undesirable forces cause problems in the bearings of the shafts 94 and 96 or cause the carriage 36 to jam on the support rods 38. In the carriage transfer mechanism a pair of upper and lower connecting bars 108 and 110 are each pivoted at one end to the carriage 36 and at their other ends to the opposite vertices 112*a* and 112*b* of an equilateral triangular member 112. The third vertex 112*c* includes a projecting member 114 which extends away from the vertex 112*c* on the side facing away from the chain 40. This projecting member 114 is circular and is captured by a rectangular bracket 116 which forms part of a cranking mechanism 118 rotatably mounted to the carriage 36. The opposite end of the cranking mechanism 118 is connected by means of a pivoted link 120 to one end of a lever 122 whose other end is connected to one end of a shaft 124 rotatably mounted in the vertical flange 98. The opposite end of the shaft 124 is connected to one end of another lever 126 on the opposite side of the flange 98 from the lever 122. The free end of the lever 126 is pivotally connected to the top of the pin 34, which is normally biased downwardly by a compression spring 128. When the pin 34 is at its lowest position it locks the closed jaws 32 together jas best seen in FIG. 2. When the pin 34 is raised by the counterclockwise movement of the levers 122, 126 and the shaft 124, the jaws are free to be pulled open by a pair of tension springs 132 attached to the carriage 36, provided the cam follower rollers 44 are not positioned at the step portion 48 of the linear cam 42. The opening of the jaws 32 released the creased work piece 10.

Referring now more particularly to FIGS. 2 and 3, the cranking operation of the carriage transfer mechanism by which the levers 122 and 126 are rotated will be described. As the carriage 36 approaches the end of the transfer mechanism at which the sprocket gear 92 is situated, that is, the right end as viewed in the figures, the crank mechanism 118 is aligned such that the projecting pin 114 engaged in the crank bracket 116 holds the free end of the lever 122 in its lowered position. As the vertex 112*c* of the triangular member 112 passes with the driving chain 40 about the circumference of the sprocket gear 92 from the 90° position, the projecting pin rotates the bracket 116 counterclockwise about the cranking axis of the cranking mechanism 118 with the result that at the 0° position the connecting link 120 is lifted and the lever 122 is rotated counterclockwise to lift the pin 34 and allow the jaws 32 to open.

As the projecting pin 114 travels through a complete 180° portion of the circumference of the sprocket gear 92 to the 270° position, the bracket 116 continues through its counterclockwise rotation to crank the connecting link 120 upwardly to raise the free end of the lever 122. This, in turn, holds up the pin 34 which, in any case, is prevented from seating by a pair of crossed boss members 130 on the jaws 32 and oriented to rotate open with the closing of the jaws 32. The carriage 36 and open jaws 32 thereafter travel back to the registration table 16 where the jaws 32 are closed by the cam step portion 48.

As the projecting pin 114 continues around the circumference of the sprocket gear 90 and begins its travel along the upper length of the driving chain 40, the process for moving the pin is reversed. The bracket 116 is rotated clockwise by the pin 114 and the connecting link moves the levers 122 and 126 clockwise to lower the pin 34 and lock the jaws 32 closed. The blade 28 thereafter rises and jams the folded work piece into the closed jaws and the process is repeated.

Although the foregoing invention has been described in some detail by way of illustration and example for purposes of clarity of understanding, it is understood that certain changes and modifications may be practiced within the spirit of the invention as limited only by the scope of the appended claims.

What is claimed is:

1. Apparatus for folding a web-like work piece comprising a folding blade, means for actuating the folding blade to travel in a predetermined direction, means for positioning the work piece with respect to the blade in a plane non-parallel to the direction of blade travel and means for triggering the blade actuating means to cause the blade to impact with the work piece so as to fold it and then withdraw to its original position, and wherein the folding blade actuating means includes a two ended toggle linkage connected at one end in a driving relationship with the folding blade, the toggle linkage having a normally flexible knee joint between the two ends, means for supplying a constantly reciprocating driving force to the other end of the toggle linkage, and electromechanical means for selectively locking the knee joint whereby the driving force is transmitted to the folding blade when the knee joint is locked and is diverted into flexing the knee joint when the knee joint is unlocked, the electromechanical means including a stationary frame, a selectively energizable coil, an armature, the armature being immovable with respect to the coil when the coil is energized, and means for pivotally connecting the coil and the armature between the stationary frame and the knee joint to constrain the knee joint from flexing after the coil is energized.

2. Apparatus as recited in claim 1 further comprising resilient clamping means having a pair of gripping jaws positioned with respect to the folding blade and the work piece such that the folded work piece is jammed in between the jaws at the fold upon actuation of the folding blade and is thereafter pulled free of the folding blade by the jaws upon withdrawal of the folding blade.

3. Apparatus as recited in claim 2 wherein the clamping means are selectively openable and closeable and further comprising means for moving the clamping means and the work piece from the location of the blade to a second location and for automatically causing the clamping means to release the work piece at the second location by opening the jaws.

4. Apparatus as recited in claim 1 wherein the means for positioning the work piece comprise a transparent table for supporting the work piece, the table having a slot therethrough to accommodate the movement of the folding blade, means for translating the table in at least two directions orthogonal to the direction of movement of the folding blade and for rotating the table in response to electrical, position control signals, the photo-optic sensor means positioned beneath the table surface for generating the electrical, position control signals, the photo-optic sensor means including means for shining light through the table, and means for sensing light reflected by the work piece through the table.

5. Apparatus for providing selective, switchable means for controlling the movements of two co-acting parts to have a predetermined timed relation with each other comprising a two ended toggle linkage connected at one end in a driving relationship with one of the two co-acting parts, the toggle linkage being normally flexible at a point intermediate its ends and selectively lockable into a rigid, linear member by the application of a constraining force to the intermediate point, the toggle linkage when locked being capable of transmitting a driving force applied to its other end in a linear motion in a direction of the toggle linkage's length from end to end, mechanical means for applying a reciprocating, linear driving force to the other end of the toggle linkage and for simultaneously driving the other co-acting part, and electromechanical means for selectively applying a constraining force to lock the toggle linkage in order to transmit the driving force to the one co-acting part in a timed relation with the driven other co-acting part, the electromechanical means including an armature, a selectively energizable coil, the armature being movable with respect to the coil when the coil is unenergized and immovable with respect to the coil when it is energized and in contact with the coil, either the armature or the coil being mounted stationary with respect to the intermediate point of the toggle linkage and the other of the armature or the coil being pivotally connected to the intermediate point of the toggle linkage whereby upon energization of the coil and contacting of the armature with the coil, the intermediate point of the toggle linkage is constrained from flexing.

6. Apparatus as recited in claim 5 wherein the toggle linkage comprises first and second two ended, elongated driving links, the first link being pivotably connected at one end to the means for applying the driving force and pivotally connected at its other end to one end of the second link to thereby establish a movable pivot point, the second link being operatively connected at its other end to drive the one co-acting part when the second link is moved longitudinally, and the electromechanical means being pivotally connected to the movable pivot point between the first and second links.

7. Apparatus for impacting a work piece with a rigid shaping element comprising means for selectively actuating the shaping element to travel in a predetermined direction from a first position to a second position and back again, and means for positioning the work piece at the second position to be impacted by the shaping element, and wherein the shaping element actuating means comprise means for supplying a continuously reciprocating driving force, a first two ended link, a second two ended link, the first link being pivotally connected at one end to one end of the second link to form a knee joint, the other end of the first link being mechanically connected to the reciprocating driving force means to thereby receive the driving force and be moved longitudinally by it, the other end of the second link being pivotally connected to the shaping element, a stationary solenoid coil, an armature plate, means for movably mounting the armature plate so that it can be moved into contact and out of contact with the solenoid coil, a third two ended link, the third link being pivotally connected at one end to the knee joint and at its other end to the armature plate, and means for selectively supplying electric current to the solenoid coil to energize it and magnetically attract the armature plate and hold it stationary, whereby the driving force is dissipated by the flexing of the knee joint in the absence of a supply of electric current to the solenoid coil and the driving force is transmitted through the first and second links to the shaping element when electric current is supplied to the solenoid coil by the electric current supply means to hold the armature plate stationary and hence to constrain the knee joint against pivotal movement.

* * * * *